US005566601A

United States Patent [19]

Mueller et al.

[11] Patent Number: 5,566,601

[45] Date of Patent: Oct. 22, 1996

[54] APPARATUS FOR CUTTING CONTAINERS, AWAY FROM A FOIL WEB

[75] Inventors: Peter Mueller, Mutlangen; Martin Beck, Urbach, both of Germany

[73] Assignee: Robert Bosch GmbH, Stuttgart, Germany

[21] Appl. No.: 317,657

[22] Filed: Sep. 30, 1994

[30] Foreign Application Priority Data

Oct. 1, 1993 [DE] Germany ..... 43 33 528.4

[51] Int. Cl.[6] ..... B26D 1/06; B26D 7/06

[52] U.S. Cl. ..... 83/123; 83/202; 83/161

[58] Field of Search ..... 83/123, 154, 161, 83/125, 127, 128, 914, 202, 35, 36

[56] References Cited

U.S. PATENT DOCUMENTS 521,660 6/1894 Lucas ..... 83/128
3,154,991 11/1964 Durtschi ..... 83/36
3,735,654 5/1973 Jurasek ..... 83/152

FOREIGN PATENT DOCUMENTS 121707 6/1901 Germany ..... 83/128

*Primary Examiner*—Kenneth E. Peterson
*Assistant Examiner*—Sean A. Pryor
*Attorney, Agent, or Firm*—Edwin E. Greigg; Ronald E. Greigg

[57] ABSTRACT

An apparatus for cutting away containers, arranged in rows in a foil web having support platforms, which are rotatable perpendicular to the conveying direction and are surrounded by receptacles of a vertically movable die. To cut the containers away from the foil web, the die cooperates with a likewise vertically movable cutting knife. The support platforms have support faces, which have two different extensions offset from one another. If the support platforms are rotated with the die in the lowered position, then their maximal extensions form a gapless conveyor path for the containers, so that they can be removed from the apparatus without the danger of canting in the interstices between the support platforms.

15 Claims, 1 Drawing Sheet

Fig. 1
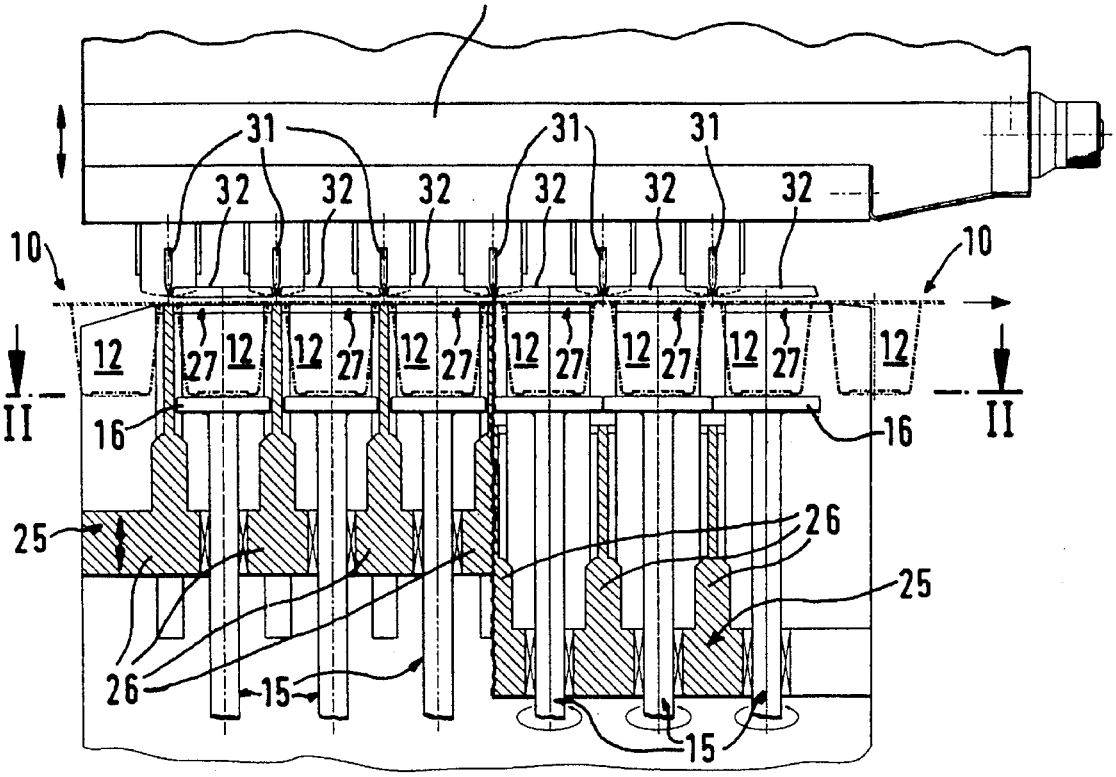
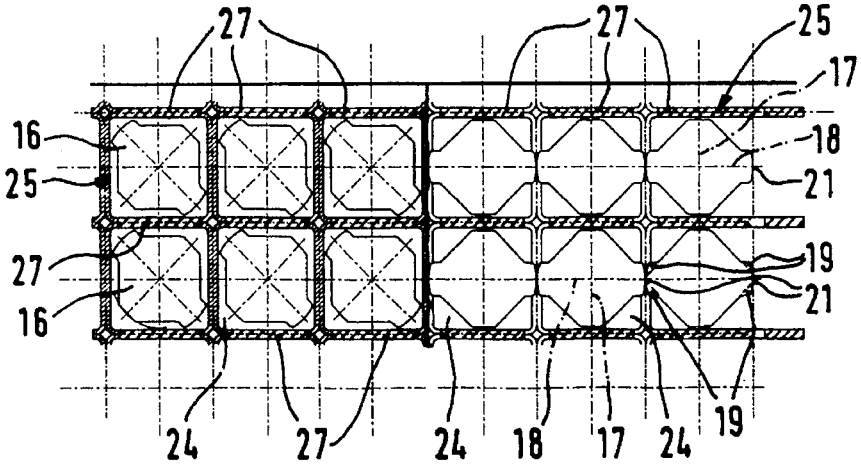
Fig. 2

APPARATUS FOR CUTTING CONTAINERS, AWAY FROM A FOIL WEB

BACKGROUND OF THE INVENTION

The invention relates to an apparatus for cutting containers away from a foil web. One such apparatus for cutting away deep-drawn, filled plastic packages is known from German Patent Disclosure DE 31 18 946 A1. It has support platforms on which the containers stand while they are being cut away. The support platforms are surrounded by a vertically raisable and lowerable die, which cooperates with a cutting knife, disposed above it, that determines the outer contour of the containers. Conveyor belts that extend in the plane of the support platforms serve to deliver and remove the containers. A disadvantage of the known apparatus is that there are interstices between the support platforms and the die in which the containers can become jammed when the die is lowered, especially on being expelled from the apparatus after they have been cut away.

An apparatus is also known from German Patent Disclosure DE 32 35 005 A1, in which support platforms remove the cut-away containers upward, in suitably embodied stacking conduits. The support platforms are vertically movable for that purpose. Aside from the high structural cost dictated by the vertically movable support platforms and by the stacking conduits, the apparatus requires one additional operating cycle to expel the cut-away containers. This keeps the capacity of the apparatus relatively low.

OBJECT AND SUMMARY OF THE INVENTION

The apparatus according to the invention has the advantage over the prior art that the support platforms are rotatable about their axes extending in the direction of motion of the die, and they have two different extensions, offset from one another. When the containers are delivered and removed, the support platforms are rotated from one of their angular positions to the other, with the die lowered. This creates a continuous conveying path in the conveying direction of the containers, and thus enables secure transporting of the containers in the apparatus.

It is especially advantageous to embody the die with lengthwise and crosswise ribs that are movable independently of one another. The lengthwise ribs, which remain in a raised position during removal of the containers, then form a lateral guide.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 1 is a simplified side view of an apparatus for cutting away containers, disposed, in rows in a foil web with a raised die on the left of the drawing and a partially lowered die on the right; and FIG. 2 is a section view through a detail of the apparatus of FIG. 1, taken along the line II—II.

DESCRIPTION OF THE PREFERRED EMBODIMENTS

The apparatus for cutting away containers. 12, disposed in rows in a foil web 10, is adjacent to a filling and sealing apparatus, not shown. There, the containers 12 produced by deep drawings are filled with a food product, such as yogurt, and then sealed with a cover foil. From there, the containers 12 are moved, by a conveyor device again not shown, to the apparatus according to the invention.

This apparatus has six rows, for example, of support platforms 15 disposed in the conveying direction of the containers 12. The support platforms 15 are rotatable about their axes, which are perpendicular to the conveying direction, between two angular positions that are 45° apart. Perpendicular to their axes of rotation, the support platforms 15 have platelike support faces 16 disposed in the plane of conveyance of the containers 12. These support faces 16 have two different extensions 17, 18, offset from one another by 90° and intersecting one another in the middle. The outline of the support faces 16 is essentially square; in the direction of the minimal extensions 17, the opposite corners are cut off at right angles to the length, making one diagonal of the square shorter. In the direction of their maximal extensions 18, the corner regions of the support faces 16 are each widened by two nearly triangular segments 19; the resultant edges 21 are rounded convexly.

In one angular position of the support platforms, their maximal extensions 18 in the conveying direction are aligned with one another, so the support faces 16 abut one another virtually gaplessly at the edges 21. In the other angular position, rotated by 45° from the conveying direction, the spacing between support faces 16 to all sides is so great that the support faces 16 find space with play in square receptacles 24 in a vertically movable die 25.

The die 25 has crosswise and lengthwise ribs 26, 27, respectively, which can be raised and lowered independently of one another. The ribs 26, 27 are widened in the part that is always located beneath the support faces 16 and in which the support platforms 15 are guided. The spacing of the lengthwise ribs 27 from one another is so great that even when they are in the raised position, the support faces 16 can be rotated between their two angular positions without touching the ribs 27. In the basic position of the-die 25, the crosswise ribs 26 are lowered all the way beneath the support faces 16. The tops of the lengthwise ribs 27, in a raised position, are located on the underside of the foil web 10. In the working position of the die 25, the crosswise ribs 26 are likewise raised as far as the underside of the foil web 10.

The die 25 cooperates with a likewise vertically movable cutting knife 30, which can be lowered as far as the ribs 26, 27. The cutting knife 30 has blades 31, 32, which are disposed to meet the cutting edges on the tops of the ribs 26, 27. The disposition of the blades 31, 32 determines both the outer contour of the containers 12 to be cut away, and also their number.

A conveyor device not shown adjoins the outlet region of the apparatus, for removal of the cut-away containers 12.

The apparatus according to the invention functions as follows:

In the basic position of the apparatus, the crosswise ribs 26 are in their lowered position, below the support faces 16. The lengthwise ribs 27 are in their raised position, at the level of the underside of the foil web 10. The support faces 16 are aligned with their maximal extensions 18 in the conveying direction, and in that direction they form a virtually gapless conveyor path for the containers 12. The cutting knife 30 is in the raised position, above the foil web 10.

For insertion of the containers 12 into the apparatus, the foil web 10 is moved in the conveying direction in increments of six rows of containers 12 at a time. The raised lengthwise webs 27 function as a guide for the containers 12. As soon as the containers 12 are positioned on their associated support platforms 15, they are rotated by 45° about their axes, which are parallel to the direction of motion of the die 25. Next, the crosswise ribs 26 are moved into their working position as well, so that they rest on the underside of the foil web 10, between the containers.

To cut the containers 12 away from the foil web 10, the cutting knife 30 is now moved downward as far as the top of the ribs 26, 27. Once the containers 12 have been cut away, the cutting knife 30 moves back to its raised position and the crosswise ribs 26 move back to their lowered position beneath the support faces 16, while conversely the lengthwise ribs 27 remain in their raised position. For expelling the now separated containers 12, the support platforms 15 with their support faces 16 are rotated again, so that the support faces 16 now adjoin one another with their maximal extensions 18 in the conveying direction. In the next conveying increment, which again introduces six rows of containers 12 into the apparatus, the cut-away containers 12 are pushed out of the apparatus by the oncoming foil web 10. Because the support faces 16 form a virtually gapless conveyor path in the conveying direction, the containers 12 can be pushed onto the adjoining conveyor device without any danger of becoming jammed between the support faces 16. The lengthwise ribs 27 that remain in the raised position form a lateral guide for the containers 12.

It should further be noted that the lengthwise ribs 27 can also be moved upward and downward in common with the crosswise ribs 26. In that case, the die 25 can be simplified by having the ribs 26, 27 be rigidly joined together.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An apparatus for cutting containers (12) away from a foil web (10, comprising a cutting knife (30) that determines an outer contour of a certain number of containers (12) arranged in rows; a die (25) that is movable counter to the cutting knife (30) and has receptacles (24) for the containers (12) that are to be cut away; and support platforms (15), disposed in the receptacles (24) of the die (25), the die (25) being lowerable beneath a plurality of support faces (16) of the support platforms so as to deliver and remove the containers (12), the support platforms (15) are disposed rotatably between two angular positions about aligned axes disposed in a direction of motion of the die (25), and crosswise to their axes of rotation have two different extensions (17, 18), offset by an angle, so that in one angular position they are received with play in the receptacles (24), and in another angular position, with the die (25) lowered, aligned with one another by a longer length (18), they form a virtually gapless conveyor path for the containers (12).

2. An apparatus as defined by claim 1, in which the two extensions (17, 18) of the support faces are perpendicular to one another.

3. An apparatus as defined by claim 2, in which the two extensions (17, 18) intersection one another in middle portion.

4. An apparatus as defined by claim 3, in which the die (25) comprises crosswise and lengthwise ribs (26, 27) that are vertically movable independently of one another.

5. An apparatus as defined by claim 3, in which the outlines of the support faces (16) are essentially square, with one set of two opposed corners shortened perpendicular to direction of a length (17), and another set of two corners widened at right angles to a direction of a length (18).

6. An apparatus as defined by claim 3, in which the two angular positions of the support platforms (15) are offset by 45°.

7. An apparatus as defined by claim 2, in which the outlines of the support faces (16) are essentially square, with one set of two opposed corners shortened perpendicular to a direction of a length (17), and another set of two corners widened at right angles to a direction of a length (18).

8. An apparatus as defined by claim 2, in which the die (25) comprises crosswise and lengthwise ribs (26, 27) that are vertically movable independently of one another.

9. An apparatus as defined by claim 2, in which the two angular positions of the support platforms (15) are offset by 45°.

10. An apparatus as defined by claim 9, in which the outlines of the support faces (16) are essentially square, with one set of two opposed corners shortened perpendicular to a direction of a length (17), and another set of two corners widened at right angles to a direction of a length (18).

11. An apparatus as defined by claim 1, in which the outlines of the support faces (16) are essentially square, with one set of two opposed corners shortened perpendicular to a direction of a length (17), and another set of two corners widened at right angles to a direction of a length (18).

12. An apparatus as defined by claim 1, in which the die (25) comprises crosswise and lengthwise ribs (26, 27) that are vertically movable independently of one another.

13. An apparatus as defined by claim 1, in which the two angular positions of the support platforms (15) are offset by 45°.

14. An apparatus as defined by claim 4, in which the outlines of the support faces (16) are essentially square, with one set of two opposed corners shortened perpendicular to a direction of a length (17), and another set of two corners widened at right angles to a direction of a length (18).

15. An apparatus as defined by claim 13, in which the die (25) comprises crosswise and lengthwise ribs (26, 27) that are vertically movable independently of one another.

* * * * *